US005259318A

United States Patent [19]

Alker et al.

[11] Patent Number: 5,259,318

[45] Date of Patent: Nov. 9, 1993

[54] DEVICE FOR THE RAPID PRODUCION OF LARGE-AREA SMOKE SCREENS

[75] Inventors: Erich Alker, Bergisch Gladbach; Johannes Eich, Troisdorf, both of Fed. Rep. of Germany

[73] Assignee: Dynamit Nobel AG, Troisdorf, Fed. Rep. of Germany

[21] Appl. No.: 468,939

[22] Filed: Jan. 23, 1990

[30] Foreign Application Priority Data

Jan. 25, 1989 [DE] Fed. Rep. of Germany ..... 3902073

[51] Int. Cl.[5] ..... F42B 13/44

[52] U.S. Cl. ..... 102/334; 02/345

[58] Field of Search ..... 102/334, 345, 512, 513

[56] References Cited

U.S. PATENT DOCUMENTS 1,735,522 11/1929 Alden ..... 102/24
3,911,823 10/1975 Murray et al. ..... 102/86.5
4,436,036 3/1984 Bell ..... 102/367
4,438,700 3/1984 Knapp ..... 102/334
4,636,364 1/1987 Kuisl et al. ..... 102/334 X

FOREIGN PATENT DOCUMENTS 0198728 2/1986 European Pat. Off. .
8605126 11/1986 PCT Int'l Appl. .

*Primary Examiner*—Peter A. Nelson
*Attorney, Agent, or Firm*—Antonelli, Terry, Stout & Kraus

[57] ABSTRACT

An expansive smoke configuration can be produced manually or automatically by the rapid, repeated discharge of smoke-forming liquid jets. A suitable device consists essentially of one or several movable tubes, each equipped with a nozzle, in conjunction with cartridges occupying the entire tube volume and having a liquid chamber and a propellant charge chamber. In case of two-component smokes, cartridges filled respectively with the two components (N1, N2) are fired in alternation. The device lends itself very well to automatic operation.

9 Claims, 2 Drawing Sheets

DEVICE FOR THE RAPID PRODUCION OF LARGE-AREA SMOKE SCREENS

The invention relates to a device for the production of a smoke screen by directional distribution of at least one smoke-forming liquid.

It is known, for example, from EP 157 421-A2, for the generation of smoke screens, to use so-called "instant smoke missiles". In this arrangement, upon disintegration of the smoke missile, the smoke can spread spherically in the air or in a dome shape along the ground or—if the smoke is ejected unilaterally during the flight from the missile—a cylindrical smoke pattern can evolve.

In spite of the name of "instant smoke missile", the formation of a solid smoke screen takes a considerable response time due to the ignition process. Only in case of liquid smokes is the response time adequately brief. Conventional devices for the generation of liquid smokes—as described in DE 3,714,454-A1—are suitable for the rapid formation of smoke screens.

It is an object of this invention to provide a device for maximally fast generation of a smoke screen wherein the orientation of the screen in the terrain should be changeable in a simple way and wherein it is also to be possible to produce smoke configurations other than merely planar.

The device according to this invention, in attaining this object, is characterized by at least one unilaterally open tube movable on a mount support, this tube being provided at the front end with a nozzle and at the rear end with a breech and an ignition mechanism, for accommodating a cartridge built up of a liquid chamber with at least one smoke-forming liquid and a propellant charge chamber, this cartridge filling the tube volume or interior entirely or substantially entirely.

A preferred further development of this invention is characterized in that there is a separating means arranged between the liquid chamber and the propellant charge chamber of the cartridge, this means being designed as a plunger in contact with the inner wall of a propellant charge chamber and enclosing a cavity; an end face of the plunger oriented toward the liquid chamber exhibiting one or several intentional breaking zones.

Two embodiments are especially preferred:

In one instance, the breech is connected with a magazine; this device is similar to a machine gun. In the other instance, several tubes, arranged in parallel to one another, are provided on the mount in this device; this arrangement has a certain similarity to a mine mortar.

In case of single-component smokes, smoke is formed immediately upon discharge from the nozzle; in case of a two-component smoke, this occurs upon discharge and intermixing of the first component with the second component. Within a very few seconds, a jet formed from one to two liters of liquid and disintegrating into droplets has been distributed in the terrain. It is possible, in particular, by means of the device of this invention to fire in rapid succession numerous cartridges and to produce differing smoke configurations on account of the movability of the at least one tube. For the fast buildup of a dense, planar smoke screen, it is, of course, advantageous to fire in the plane of the screen several jets of the smoke-generating liquid(s). It is readily possible by means of the device according to the invention to adapt, or also to vary, the orientation of a smoke screen in analogy to the observed direction of movement of the object (for example a helicopter) within a very short time period.

Although the device of this invention can produce, per shot, only one jet of liquid droplets, it is easily possible to generate therewith two component smokes by firing in succession two different cartridges with the smoke components without a substantial adjustment of the tube. Two-component liquid smokes, in particular, can be produced considerably faster with the device of this invention than heretofore.

The device according to this invention is preferably connected to a computer device for controlling the tube movement and the firing sequence a plurality of open tubes. By means of appropriate sensors and an evaluating logic, smoke screens resulting in camouflage adapted to the threat can be generated within a minimum time automatically.

The invention is illustrated in the accompanying drawings and described by way of the following embodiments. In the drawings.

Figure 1:
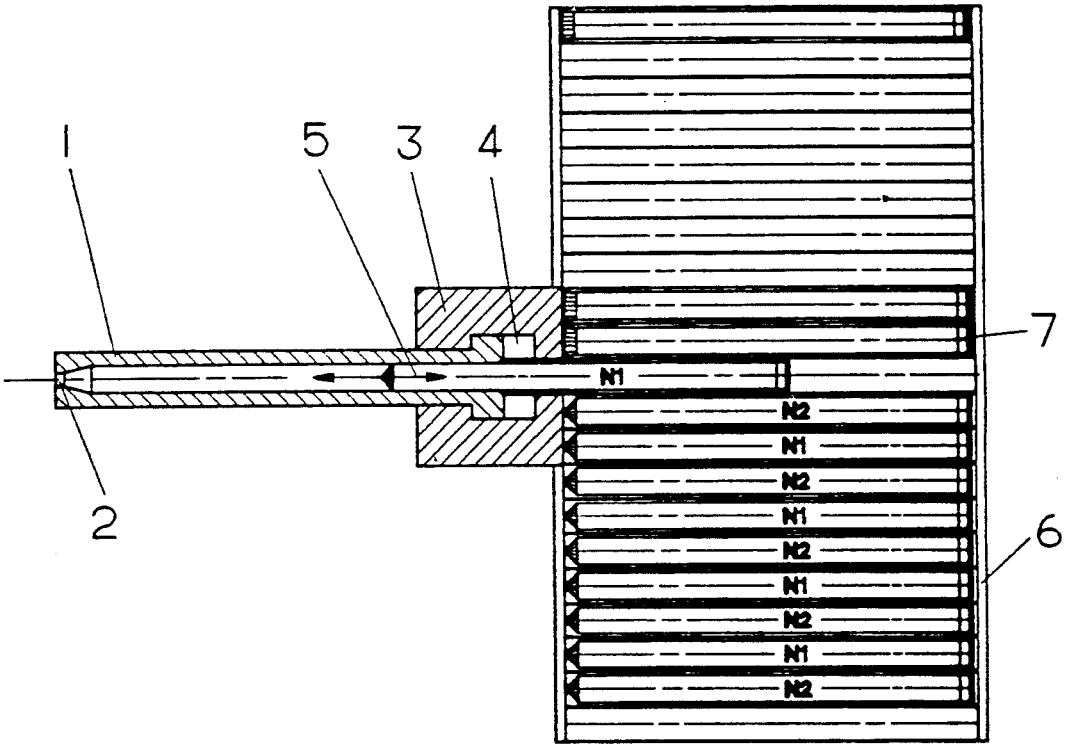
FIG. 1 is a schematic view, partially in section, through a device for the broad distribution of two smoke-generating liquid components.

A tube 1, movable toward all directions, is installed on a mount support. The tube has an opening that is narrowed by a nozzle 2; the other end of the tube is provided with a breech 4 and an igniting device, accommodated in a breech head 3. The interior of the tube is practically completely occupied by a cartridge 5. A cartridge magazine 6, operatively associated with the tube 1, is illustrated merely schematically. The lower zone contains alternatingly arranged cartridges filled with the two smoke components N1 and N2 The empty ammunition 7 is deposited in the upper zone of the magazine 6.

Figure 2:
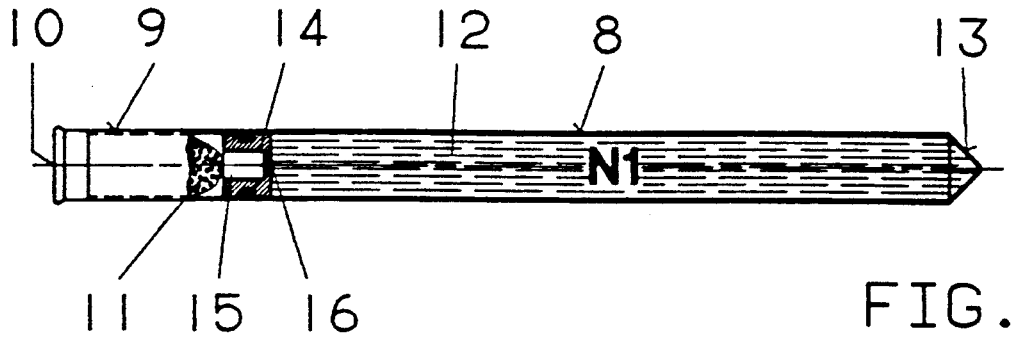
FIG. 2 is a schematic view, partially in section, through a cartridge with one smoke-forming liquid component.
Figure 3:
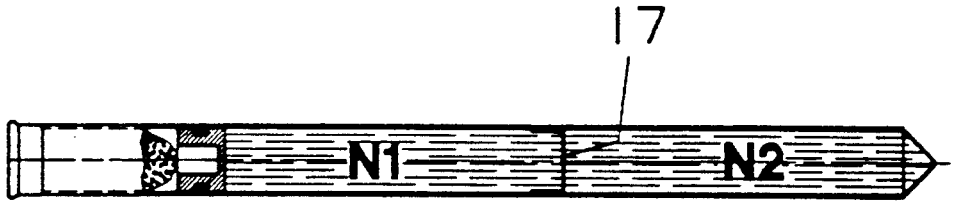
FIG. 3 is a schematic view, partially in section, through a cartridge with two liquids for a two-component smoke.

Two types of cartridges are illustrated in FIGS. 2 and 3. Such cartridges for spraying liquid components have been known from DE 3,545,737-C1. A cartridge consists essentially of a liquid chamber 8 and a propellant charge chamber 9, in this case attached to the liquid chamber 8. In the bottom piece or part of the propellant charge chamber 9, an igniter 10 is centrally located for igniting the propellant charge powder 11. The liquid 12 for the formation of a single-component smoke is titanium tetrachloride. The volume of the liquid corresponds in its size to the volume of the gases generated upon ignition of the powder 11. The forward zone of the liquid chamber 8 is sealed by a crimp 13. The crimp 13 provides a weakened zone at the end of the tube through which the liquid 12 escapes with droplet formation if the liquid pressure in the liquid chamber 8 rises to a sufficient extent.

The design of the transition or separating zone between the propellant charge chamber 9 and the liquid chamber 8 is characteristic of this invention. This separating zone is constituted by a plunger 14 in contact with an inner wall of the tube and enclosing a cavity 15; the end face 16 of the plunger, oriented toward the liquid chamber 8, exhibits one or several intentional breaking zones. On account of this design of the cartridge, the objective is achieved that the smoke-generating liquid is driven completely out of the liquid chamber 7 within the shortest possible time.

A smoke droplet jet of 50 meters or more can be generated per shot. A firing sequence of more than two shots per second is feasible. With alternating firing of the two smoke components, two-component liquid smoke can be produced with practically the same speed as a single-component liquid smoke.

A two-component smoke cartridge is illustrated in FIG. 3. This cartridge exhibits a separating member 17 between the two liquids N1 and N2.

Automatic control of the tube movement and of the firing sequence permits the buildup of differing smoke configuration within a minimum time period.

Figure 4:
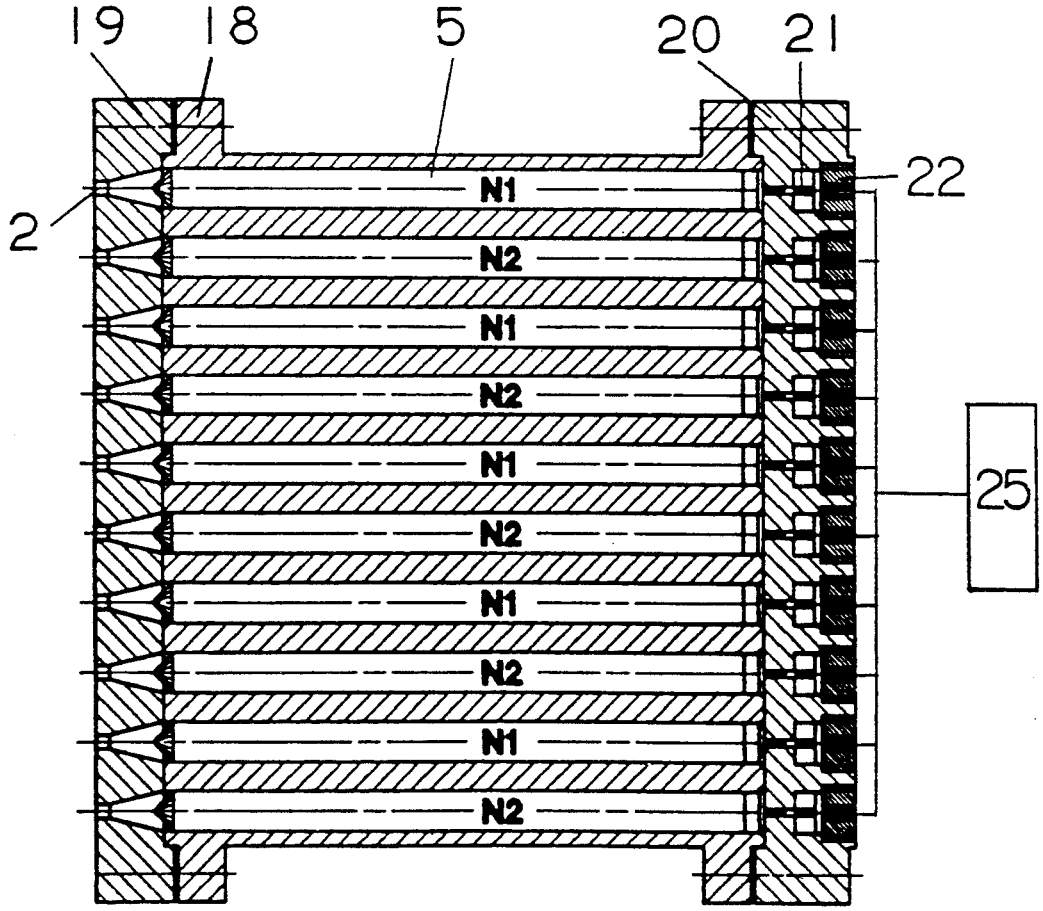
FIG. 4 is a cross-section through a caliber block of a two-component smoke mortar.

Another device according to this invention for the rapid generation of a smoke screen is illustrated in FIG. 4: This device is also suitable for producing a two-component smoke. Identically acting parts bear the same reference numerals as in FIG. 1. In this arrangement, 3 sets of 10 tubes are disposed in 3 parallel planes in a caliber block 18 connected at the front with a nozzle plate 19. The rearward portion is covered by a cover plate 20: a striker pin 21 is indicated, having a threaded section 22. Controller unit 25 is schematically shown and is connected to each of the striker pins to cause movement thereof.

What is claimed is:

1. A device for the production of a smoke screen by directional distribution of at least one smoke-forming liquid, which comprises at least one unilaterally open tube movable on a mount support, said tube being provided at a front end with a nozzle and at a rear end with a breech and an igniter mechanism, for the accommodation of a cartridge having a liquid chamber containing at least one smoke-forming liquid and a propellant charge chamber, this cartridge occupying the tube interior entirely during production of said smoke screen.

2. A device for the production of a smoke screen by directional distribution of at least one smoke-forming liquid, which comprises at least one unilaterally open tube movable on a mount support, said tube being provided a front end with a nozzle and at a rear end with a beech and a igniter mechanism, for the accommodation of a cartridge having a liquid chamber containing at least one smoke-forming liquid and a propellant charge chamber, this cartridge occupying the tube interior entirely; a separating means being provided in the cartridge between the liquid chamber and the propellant charge chamber, said separating means comprising a plunger which is in contact with an inner wall of the propellant charge chamber and which encloses a cavity, an end face of said plunger oriented toward the liquid chamber exhibiting at least one intentional breaking zone.

3. A device for the production of a smoke screen by directional distribution of at least one smoke-forming liquid, which comprises at least one unilaterally open tube movable on a mount support, said tube being provided a front end with a nozzle and at a rear end with a breech and a igniter mechanism, for the accommodation of a cartridge having a liquid chamber containing at least one smoke-forming liquid and a propellant charge chamber, this cartridge occupying the tube interior entirely; the breech being connected to a magazine holding a plurality of said cartridges.

4. A device for the production of a smoke screen by directional distribution of at least one smoke-forming liquid, which comprises at least one unilaterally open tube movable on a mount support, said tube being provided a front end with a nozzle and at a rear end with a breech and a igniter mechanism, for the accommodation of a cartridge having a liquid chamber containing at least one smoke-forming liquid and a propellant charge chamber, this cartridge occupying the tube interior entirely;

several tubes being present which are arranged mutually in parallel.

5. A device for the production of a smoke screen by directional distribution of at least one smoke-forming liquid, which comprises a unilaterally open tube movable on a mount support, said tube being provided at a front end with a nozzle and at a rear end with a breech and an igniting means, and a cartridge positioned within said tube, said cartridge having a liquid chamber containing at least one smoke-forming liquid at a front end of the cartridge, a propellant charge chamber at a rear end of the cartridge and means for separating the liquid chamber from the propellant charge chamber, said cartridge occupying the tube so that the front end of the cartridge is located adjacent to the nozzle and the rear end of the cartridge and the propellant charge chamber is located adjacent to the igniting means whereby, upon ignition of the propellant charge within the charge chamber, the separating means is driven toward the front end of the cartridge and the liquid within the liquid chamber is discharged from the nozzle.

6. A device according to claim 5, wherein said separating means comprises a plunger which is in contact with a propellant charge chamber and which is provided with a cavity facing toward the propellant charge chamber and an opposite end face of the plunger providing an inner wall of the liquid chamber, said end face exhibiting at least one intentional breaking zone.

7. A device according to claim 5 or claim 6, wherein the front end of the cartridge is sealed by a weakened portion through which liquid escapes with the formation of liquid droplets when liquid pressure in the liquid chamber is increased.

8. A device according to claim 2, wherein the breech is connected to a magazine holding a plurality of said cartridges.

9. A device according to claim 2, wherein several tubes are present which are arranged mutually in parallel.

* * * * *